US005182871A

United States Patent [19]

Karls

[11] Patent Number: 5,182,871

[45] Date of Patent: Feb. 2, 1993

[54] APPARATUS FOR DRYING BULK MATERIALS

[75] Inventor: Dieter Karls, Vaihingen, Fed. Rep. of Germany

[73] Assignee: Filterwerk Mann & Hummel GmbH, Ludwigsburg, Fed. Rep. of Germany

[21] Appl. No.: 793,563

[22] Filed: Nov. 18, 1991

[30] Foreign Application Priority Data

Nov. 24, 1990 [DE] Fed. Rep. of Germany ..... 4037443

[51] Int. Cl.[5] ..... F26B 21/00

[52] U.S. Cl. ..... 34/54; 34/169; 34/56

[58] Field of Search ..... 34/52, 54, 165, 168, 34/169, 57 R, 26, 31, 56

[56] References Cited

U.S. PATENT DOCUMENTS

| | | | |
|---|---|---|---|
| 2,069,193 | 1/1937 | Behr et al. | 34/169 |
| 2,676,095 | 4/1954 | Vaney et al. | 34/54 |
| 2,903,800 | 9/1959 | Skoglund | 34/54 |
| 3,305,939 | 2/1967 | Sonnenschein et al. | 34/54 |
| 3,563,460 | 2/1971 | Nine | 34/54 |
| 3,875,683 | 4/1975 | Waters | 34/169 |
| 4,004,351 | 1/1977 | Sanneman et al. | 34/52 |
| 4,053,991 | 10/1977 | Steffen | 34/54 |
| 4,152,840 | 5/1979 | Stille | 34/56 |
| 4,413,426 | 11/1983 | Graeff | 34/27 |
| 4,568,417 | 2/1986 | Agarwal | 34/54 |
| 4,624,059 | 11/1986 | Hammarskog et al. | 34/169 |
| 4,688,332 | 8/1987 | Kallestad et al. | 34/54 |

FOREIGN PATENT DOCUMENTS

| | | |
|---|---|---|
| 95265 | 11/1983 | European Pat. Off. . |
| 2052334 | 4/1972 | Fed. Rep. of Germany . |
| 3131471 | 7/1987 | Fed. Rep. of Germany . |
| 3809749 | 4/1989 | Fed. Rep. of Germany . |
| 8910763 | 2/1991 | Fed. Rep. of Germany . |
| 3929858 | 3/1991 | Fed. Rep. of Germany . |
| 2605851 | 6/1988 | France . |
| 2202318 | 9/1988 | United Kingdom . |

*Primary Examiner*—Henry A. Bennet
*Assistant Examiner*—Denise L. Gromada
*Attorney, Agent, or Firm*—Foley & Lardner

[57] ABSTRACT

An apparatus for drying bulk materials such as plastic granules which includes a substantially cylindrical hopper having a funnel-shaped bottom, a filler spout for feeding bulk material to the hopper, an air inlet with an injector tube for introducing heated dry air into bulk material situated in the hopper, a bulk material withdrawal system with a conveying duct connected to it through which the bulk material is carried to further processing, a temperature measuring system is disposed in the cylindrical portion of the hopper which measures the temperature of the bulk material, and a device which, when the measured temperature falls below a predetermined limit, either sounds an alarm or decreases or interrupts the discharge of bulk material to prevent discharge of inadequately dried material.

9 Claims, 4 Drawing Sheets

APPARATUS FOR DRYING BULK MATERIALS

BACKGROUND OF THE INVENTION

The present invention relates to an apparatus for drying bulk materials comprising a substantially cylindrical bulk material hopper with a funnel-shaped lower end, a bulk material inlet at the top of the hopper, a bulk material discharge device at the bottom of the hopper, an air inlet for introducing heated dry air for drying bulk material in the hopper, and an air outlet for discharging moisture-containing air; especially an apparatus in which the air inlet and air outlet of the hopper are connected in a closed air circuit including an air drying system for drying and heating moisture-laden air from the hopper, an exhaust air duct leading from the air outlet of the hopper to the air drying system, an air supply duct leading from the air drying system to the air inlet of the hopper, and a blower for circulating heated, dry air from said air drying system through bulk material in the hopper and moisture laden air from the hopper back to the air drying system.

European patent application No. EP 95,265 discloses an apparatus for controlling the process of drying bulk materials, in which heated air introduced into the material to dry it is analyzed with regard to its temperature and its moisture content, and the exhaust air is also analyzed for its temperature and its moisture content. A temperature sensor and a moisture sensor also are placed within the bulk material, which furnish information on the condition of the material. All of the measured values are sent to a processor which controls the drying process in accordance with the measured data. The combination of a temperature sensor and a moisture sensor is very costly. Also, it is known that the moisture sensors commonly used are very inaccurate. Particularly when the bulk material to be dried is plastic granules, this kind of drying control is inaccurate, since the drying of plastics involves the removal of a very slight residual moisture which is very difficult to measure.

German published patent application No. DE 2,052,334 discloses a method and an apparatus for drying bulk materials in which moisture is removed from the bulk material in a hopper with a heated dry gas, especially air. In order to adequately remove the moisture from a large amount of material, it is proposed to feed additional heat to the hopper. This, however, requires an additional air circuit as well as a heating system to be disposed therein, and this additional air circuit is activated when the temperature of the exhaust air falls below a predetermined level.

Normally, the bulk material dried in the hopper is removed more or less continually, and fresh bulk material corresponding to the amount removed is introduced at the top. As long as the amount of material removed is substantially constant, the heated air fed in can be adapted to this throughput of bulk material. If, however, the bulk material throughput is increased to the extent that drying with the maximum available air input is no longer sufficient, there is a danger that bulk material will leave the drying hopper with an excessively high moisture content, so that high quality further processing of this bulk material will no longer be possible. No solution of this problem can be found in the known state of the art.

SUMMARY OF THE INVENTION

It is the object of the invention to provide an apparatus for drying bulk materials which will prevent insufficiently dried bulk material from being discharged.

Another object of the invention is to provide a method and apparatus in which the introduction of heated, dry air is controlled with respect to the discharged bulk materials in a way which assures constant drying of the bulk material.

A further object of the invention is to provide a method and apparatus for drying bulk materials which will conserve energy.

These and other objects of the invention are achieved by providing an apparatus for drying bulk materials comprising a substantially cylindrical bulk material hopper having a funnel shaped bottom end, a bulk material inlet in an upper portion of said hopper, a bulk material discharge device at the bottom of said hopper, an air inlet for introducing heated dry air adjacent the bottom of said hopper, an air outlet for exhausting moisture-containing air adjacent the top of said hopper, means for feeding bulk material through said bulk material inlet, a temperature sensor disposed in said hopper at a location where a temperature gradient is established in said bulk material during normal operation of said apparatus for measuring the temperature of bulk material at said location, and means connected to said temperature sensor for preventing discharge of inadequately dried bulk material in response to a decrease in the measured temperature of said bulk material below a predetermined limit.

The invention makes use of the knowledge that a temperature gradient exists in the bulk material situated in the substantially cylindrical hopper. This temperature gradient begins at the maximum temperature of the heated dry air fed to the hopper and ends at the temperature of the freshly introduced bulk material. If a very large amount of bulk material is discharged, this temperature gradient shifts toward the bulk material outlet. If little or no bulk material is removed, the temperature gradient shifts toward the bulk material inlet.

In accordance with the invention, a temperature sensor is disposed in the area of this temperature gradient for sensing the temperature in the bulk material. This temperature corresponds to an average that establishes itself between the surface temperature of the bulk material (plastic granules, for example) and the air temperature. Now, if the temperature at the point of measurement decreases, this is an indication that a large amount of bulk material is being discharged. As soon as the measured temperature drops below a predetermined allowable limit, this signifies that bulk material is being withdrawn at a rate which is too great. Different reactions can now be initiated. For one thing, there is the possibility of emitting a visual or acoustical signal indicating excessive withdrawal of bulk material so that the bulk material discharge can be throttled down. There is also the possibility of interrupting the bulk material discharge, or of throttling it down by means of a device controlled by the temperature sensor.

The temperature sensor can, of course, also detect a rise in the temperature within the bulk material. This rise of temperature indicates that so little bulk material is being discharged that the amount of input heated dry air is too great in proportion to the bulk material discharge. Based on this relationship, when an upper temperature limit is reached, the amount of air introduced is decreased, with a consequent saving of energy in drying the bulk material.

An essential aspect of the invention is thus the use of a temperature sensor that is disposed within the bulk material in the area of the temperature gradient. The precise location of the temperature sensor is not critical. It is only important that the temperature sensor not be positioned too close to the vicinity of the hot air inlet, since there the granules assume the temperature of the heated air very rapidly. Furthermore, the temperature measurement point then would also be too close to the bulk material outlet. When bulk material is withdrawn rapidly, this could lead to the result that although the material had already reached the proper drying temperature, its residence time at that temperature would not be sufficient to dry it before discharge.

BRIEF DESCRIPTION OF THE DRAWINGS

The invention will be described in further detail hereinafter with reference to preferred embodiments illustrated in the accompanying drawings in which.

DETAILED DESCRIPTION OF PREFERRED EMBODIMENTS

Figure 1:
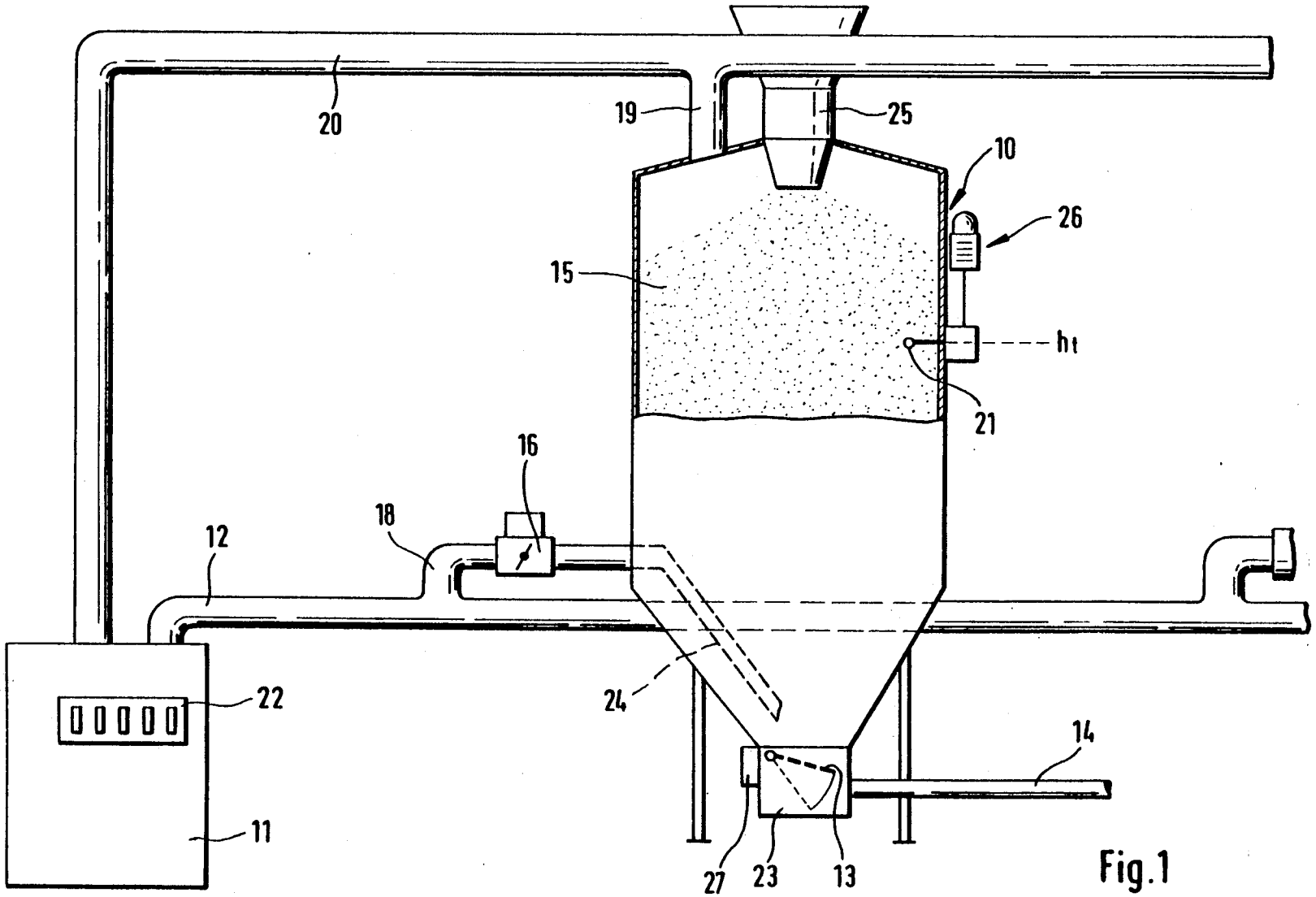
FIG. 1 shows a bulk material hopper with a warning system.

FIG. 1 shows an apparatus for drying bulk material comprising a bulk material hopper 10 provided with a filler spout 25 and a bulk material discharge device 23. The bulk material discharge is provided, for example, with a shutter 13. Discharged bulk material is carried away pneumatically through a conveyor duct 14 by an air current.

As long as the bulk material 15 in the hopper is continuously replenished through the filler spout 25, a cone of bulk material will form in the upper part of the hopper, so that the fill level is always constant.

The bulk material is dried by means of an air drying system Such a system is generally known and is described, for example, in German patent No. 3,131,471. The air drying apparatus 11 has a control panel 22 for controlling the apparatus. The drying air circulates in a closed circuit and is moved by a blower which is disposed in the air drying system 11. If a plurality of bulk material hoppers are connected with a single air drying system, the air supply duct 12 is provided with a branch for each bulk material hopper. A branch 18 is provided for hopper 10. 0n this branch there is a shut off valve 16. When the shut off valve is open, the drying air flows into an injector tube 24, illustrated here diagrammatically, which assures uniform introduction of heated dry air into the bulk material 15.

The incoming air flows upward through the bulk material 15, heats the material and simultaneously absorbs the moisture present therein, exits the hopper through the air outlet 19, and is carried by the exhaust air return duct 20 back to the air drying system 11.

If the material to be dried is plastic granules, the duct 14 is connected to one or more plastic fabricating machines, such as injection molding machines. The operating cycle of these injection molding machines is normally constant, so that the discharge of plastic granules is more or less regular, and replacement granules are introduced substantially continuously into the bulk material hopper. The amount of drying air introduced into the bulk material hopper is adjusted to match the maximum throughput of the plastic granules.

It has been found in practice that not just one, but often a number of plastic fabricating machines are connected to an apparatus for drying bulk materials. Then a situation may arise in which the amount of drying air supplied is not sufficient to satisfactorily dry such a very high bulk material throughput. Sufficient drying is achieved only if the bulk material is exposed to dry air for a certain prescribed amount of time, so that even moisture present in the interior of each individual granule is removed by the heat of the air which flows past it.

Figure 4:
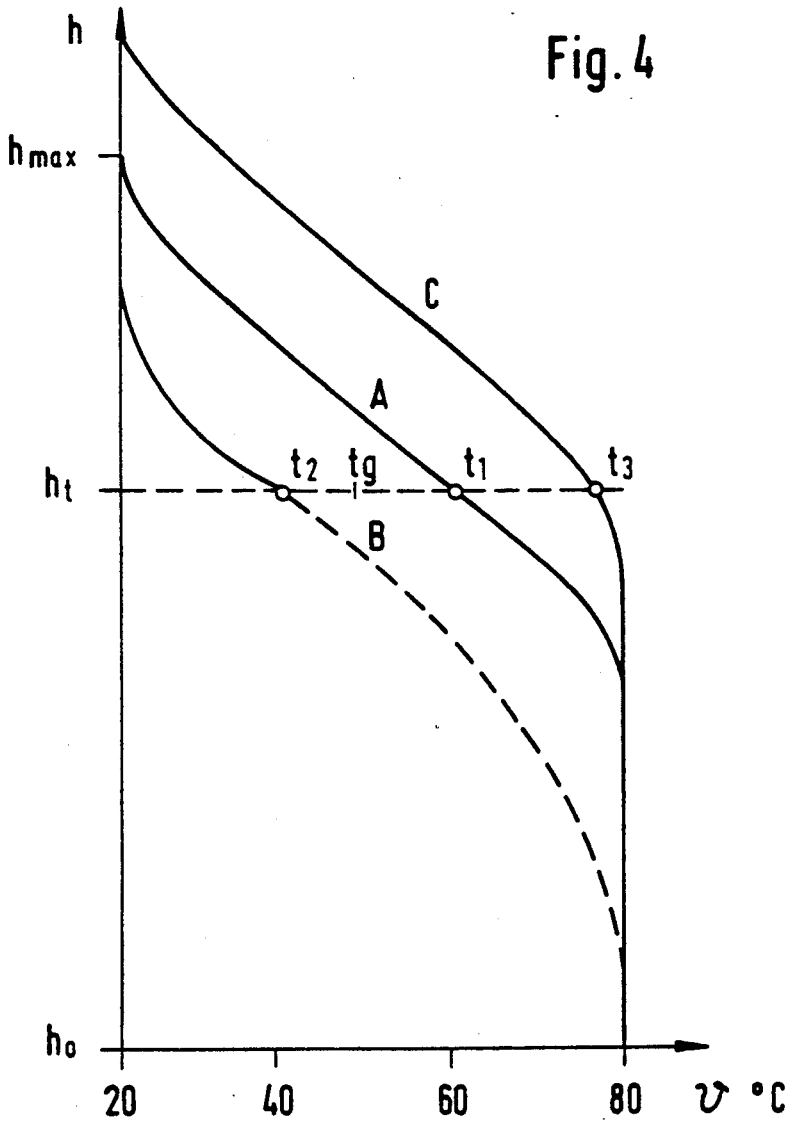
FIG. 4 is a diagram of the temperature curve in the bulk material hopper.

FIG. 4 shows the temperature pattern $\theta/°C.$ for the bulk material in the hopper over the maximum fill height. The curve A shows the temperature curve that is established when plastic granules are withdrawn regularly at a medium rate of renewal. It can be seen that in the bottom half of the hopper the temperature of the plastic granules is substantially constant and corresponds to the temperature of the heated air which is introduced, which in this case is 80° C.

In the upper part of the hopper the temperature of the bulk material diminishes continually and at the apex of the cone it usually reaches the temperature of the bulk material as it enters the hopper. This temperature is about 20 degrees. In this diagram the height of the outlet of the hopper is designated $h_0$, and $h_{max}$ represents the apex of the cone of bulk material.

As shown in FIG. 1, there is a temperature sensor at a position in the bulk material hopper that is identified in FIG. 4 as $h_t$. This temperature sensor 21 measures the temperature of the surrounding bulk material. This also substantially corresponds to the temperature of the air moving past the temperature sensor. This temperature is represented in FIG. 4 as $t_1$.

The temperature sensor 21 is connected to a signal converter 17. This signal converter converts the measured temperature to a corresponding digital electric signal. This signal is conveyed to an alarm device 26, which consists, for example, of an acoustical and a visual alarm.

If a very large amount of plastic granules is discharged, so that sufficient drying is no longer assured, the temperature gradient within the bulk hopper shifts downward, i.e., a temperature curve B will be established as indicated in FIG. 4. This temperature curve B shows that the residence of the discharged bulk material was too brief to assure sufficient drying. Although the bulk material was heated briefly to the temperature of 80° C., this brief period is not sufficient to completely dry the bulk material.

The temperature sensor detects a decrease of the temperature to point $t_2$. This temperature is below a temperature limit $t_g$ that is selected such that above this temperature limit sufficient drying of the bulk material is still assured. Below this temperature limit an alarm is emitted by the alarm system 26. This alarm indicates that the withdrawal of granules must be interrupted until the temperature limit $t_g$ is again exceeded.

Figure 2:
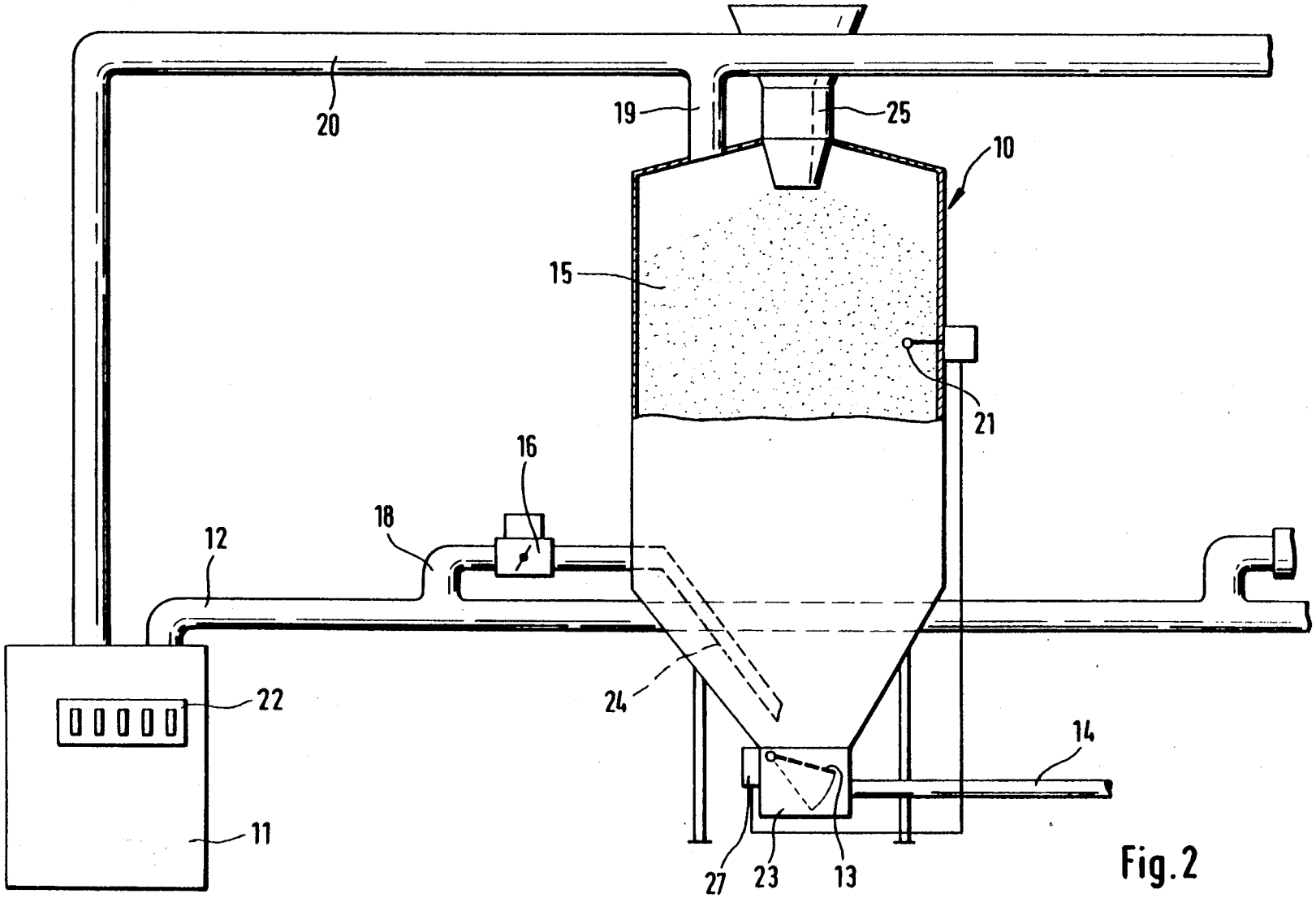
FIG. 2 shows a bulk material hopper With a shutter valve control system.

The visual and/or acoustical effect of the warning signal emitted by the alarm system 26 can cause an operator to take steps to decrease the consumption. of plastic granules. Instead of an alarm system 26, the signal converter 17 can also be connected as shown in FIG. 2 directly to a control device for the shutter means 13. With this kind of connection between the temperature sensor 21 and the shutter means 13, supervision by an operator becomes unnecessary. In this case the delivery of bulk material is automatically regulated depending on whether the temperature rises above or falls below the limit $t_g$. In other words, as soon as the temperature falls below the limit, the control device 27 causes the shutter means 13 to interrupt the flow of bulk material.

Figure 3:
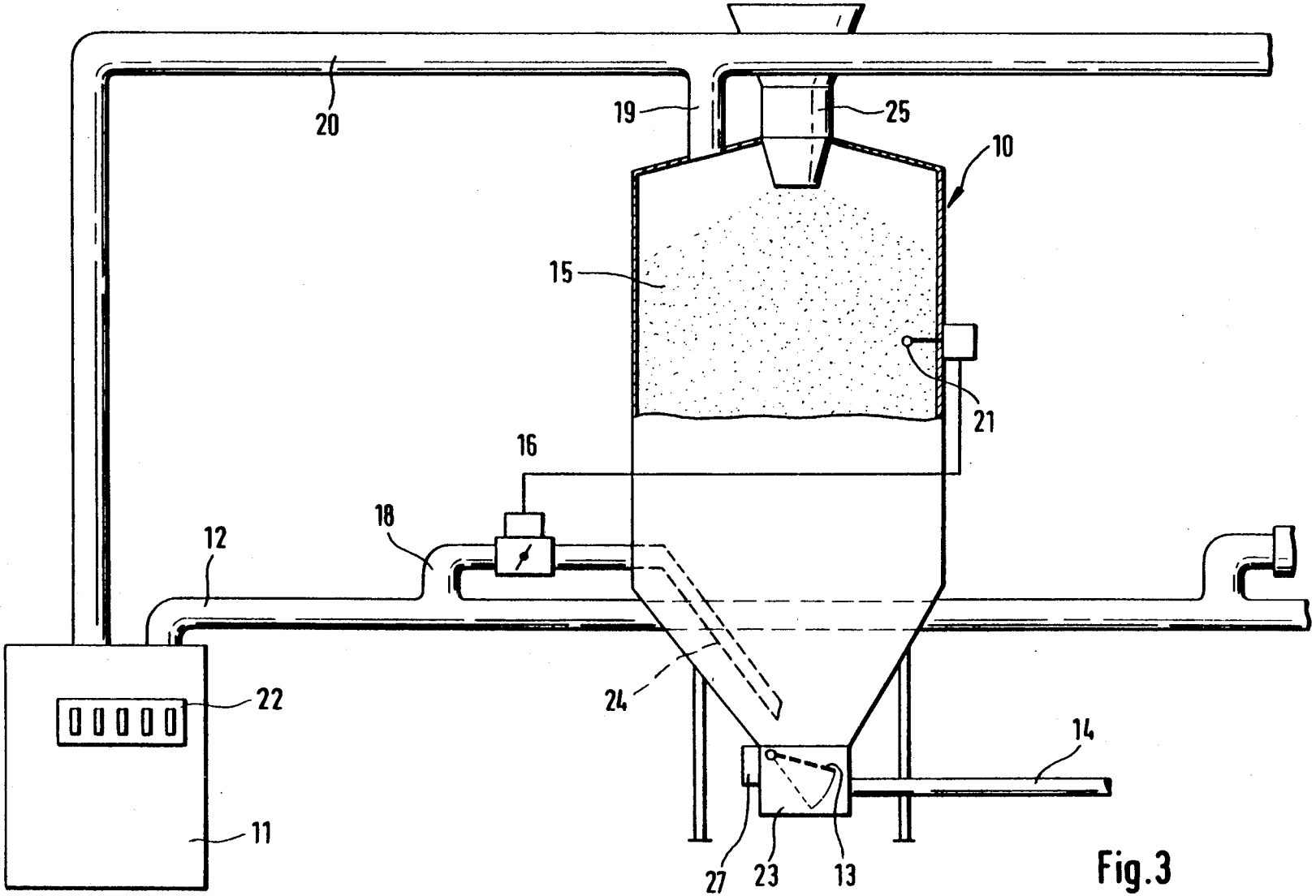
FIG. 3 shows a bulk material hopper with a heat flow control system.

Of course, it can also happen that the throughput of bulk material through the hopper may be reduced, for example, when one or more plastic fabricating machines are shut down. This can cause the temperature in the bulk material to rise if the flow of dry, heated air is not adjusted. Such a temperature rise is indicated in FIG. 4 by curve C. In that case the temperature sensor detects the temperature $t_3$. When this temperature is reached in a system as shown in FIG. 3, an actuating signal is transmitted to the shut off valve 16 by the signal converter 17. This shut-off valve throttles back the air flow and with it the amount of heat supplied, so that a further rise of the temperature in the hopper is prevented.

In FIG. 3, the controller regulates the rate of flow of air through the bulk material dryer 10 in accordance with the temperature measured by temperature sensor 21 by means of a shut off valve 16 such that if the temperature of the bulk material 15 rises above a predetermined upper limit, the air throughput is reduced, and if the temperature falls below a predetermined lower limit, the air flow is increased.

It is possible, of course, to operate the shut off valve 16 in a gradual manner, so that even in the event of a slight rise of the temperature in the hopper 10, the heat input will be reduced. At the same time the temperature sensor can also serve to control the temperature as described in connection with FIGS. 1 or 2.

Thus, with the use of a single temperature sensor, it is possible to assure adequate drying of bulk material, particularly in the case of plastic granules, as well as to achieve a substantial saving of energy while assuring adequate drying.

The foregoing description and examples have been set forth merely to illustrate the invention and are not intended to be limiting. Since modifications of the described embodiments incorporating the spirit and substance of the invention may occur to persons skilled in the art, the invention should be construed broadly to include all variations falling within the scope of the appended claims and equivalents thereof.

What is claimed is:

1. An apparatus for drying bulk materials comprising a substantially cylindrical bulk material hopper having a funnel-shaped bottom end, a bulk material inlet in an upper portion of said hopper, a bulk material discharge device at the bottom of said hopper, an air inlet for introducing heated dry air adjacent the bottom of said hopper, an air outlet for exhausting moisture-containing air adjacent the top of said hopper, means for feeding bulk material through said bulk material inlet, a temperature sensor disposed in said hopper at a location where a temperature gradient is established in said bulk material during normal operation of said apparatus for measuring the temperature of bulk material at said location, means connected to said temperature sensor for preventing discharge of inadequately dried bulk material in response to adecrease in the measured temperature of said bulk material below a predetermined limit, a valve for regulating the introcution of heated dry air to said hopper and means connected to said temperature sensor for controlling said valve to decrease the flow of heated dry air to said hopper in response to an increase in the measured temperature of said bulk material above a predetermined upper limit.

2. An apparatus according to claim 1, wherein said means for preventing discharge of inadequately dried bulk material comprises an alarm system for alerting a human operator to take appropriate measures to decrease the discharge of bulk material.

3. An apparatus according to claim 1, wherein said means for preventing discharge of inadequately dried bulk material comprise an automatic discharge device controller for at least partially interrupting discharge of bulk material from said hopper.

4. An apparatus according to claim 1, wherein said means for preventing discharge of inadequately dried bulk material comprise an automatic air flow valve controller for increasing the flow of heated dry air to said hopper.

5. An apparatus according to claim 1, wherein said air inlet and air outlet of said hopper are connected in a closed air circuit which includes an air drying system for drying and heating moisture-laden air from said hopper, an exhaust air duct leading from said air outlet of said hopper to said air drying system, an air supply duct leading from said air drying system to said air inlet of said hopper, and a blower for circulating heated, dry air from said air drying system through bulk material in the hopper and moisture-containing air exhausted from said hopper back to said air drying system.

6. An apparatus according to claim 1, wherein said means for feeding bulk material through said inlet are controlled in response to discharge of bulk material through said discharge device to maintain a substantially constant level of bulk material in said hopper.

7. An apparatus according to claim 1, wherein said temperature sensor is located a sufficient distance above the bottom of said hopper to assure that the bulk material will have an adequate residence time at maximum drying temperature to achieve complete drying.

8. An apparatus according to claim 1, wherein said discharge device discharges bulk material from said hopper at least substantially continuously.

9. An apparatus according to claim 1, wherein said temperature gradient ranges from a maximum temperature corresponding to the temperature of the heated dry air introduced into said hopper to a minimum temperature corresponding to the temperature at which bulk material is fed into said hopper.

* * * * *